US005967494A

United States Patent [19]

Fiorese

[11] Patent Number: 5,967,494

[45] Date of Patent: Oct. 19, 1999

[54] POWER LIFT FOR VEHICLES

[76] Inventor: Francesco Fiorese, Via Sant'Andrea, 50, 35020 Albignasego (Padova), Italy

[21] Appl. No.: 09/245,665

[22] Filed: Feb. 8, 1999

[30] Foreign Application Priority Data

Feb. 12, 1998 [IT] Italy ..... PD98A0029

[51] Int. Cl.[6] ..... B66F 3/22

[52] U.S. Cl. ..... 254/122

[58] Field of Search ..... 254/122, 9 R, 254/9 B, 9 C; 182/157, 158

[56] References Cited

U.S. PATENT DOCUMENTS

| | | | |
|---|---|---|---|
| 1,345,564 | 11/1920 | Thomas | 254/9 C |
| 2,931,519 | 4/1960 | Beach | 254/9 C |
| 3,180,451 | 4/1965 | Patterson | 182/158 |
| 4,076,102 | 2/1978 | Desarzens et al. | 182/157 |
| 5,695,173 | 12/1997 | Ochoa et al. | 254/9 C |

FOREIGN PATENT DOCUMENTS

| | | | |
|---|---|---|---|
| 2801863 | 10/1978 | Germany | 254/9 C |

*Primary Examiner*—David A. Scherbel
*Assistant Examiner*—Daniel G. Shanley
*Attorney, Agent, or Firm*—Bucknam and Archer

[57] ABSTRACT

A power lift for use in body shops for vehicles is described of the type which comprises a bearing plane provided in the lower part with a lifting and lowering group. The lifting group comprises corresponding to each of the lateral sides of the bearing plane a related lifting/lowering mechanism of a scissors arrangement constituted by 2 pairs of parallel levers, articulated between themselves in a middle section, one pair of parallel levers of the lifting group being provided with rollers which slide on the ground along a trajectory parallel to the longitudinal axis of the plane, and another pair of levers being hinged to the ground corresponding to the movable lower ends. The mechanism is operated by at least one fluiddynamic actuator and has one end articulated to the lower arm of one of the two pairs of parallel levers and the other end is articulated by means of a corresponding stirrup to the upper arm of one of two levers. The power lift is characterized by the fact that the stirrup is hinged to the related lever being provided with a free external end provided with a roller in related motion and kinematic coupling in the first part of the lifting phase, with a surface suitably inclined with respect to the ground defined by a related shaped block.

19 Claims, 3 Drawing Sheets

POWER LIFT FOR VEHICLES

FIELD OF THE INVENTION

The present invention relates to power lifts used in body shops for vehicles.

BACKGROUND OF THE PRIOR ART

It is known that in shops for vehicles there is the necessity of having access to the lower part of the vehicles to repair those which have been involved in accidents or which have a malfunction.

For the purpose of allowing the operator or operators to have access to the lower part of the vehicle there are used the so called "banchi di tiro" which are roller stands constituted essentially by a base frame of a rectangular shape which has some openings for the passage of templates on which the vehicle is placed and the vehicle is moved in a vertical direction by lifting means which are constituted in many instances by pantograph trolley mechanisms.

The roller stands have a structure which is heavy and complex and are provided with devices for blocking the vehicle which allow the drawing operations in the body shop, operations which impart substantial turnover stresses both on the vehicle and on the roller stands. For this reason the use of the known roller stands constitutes substantial cost, long and complex work procedures which frequently are not justifiable in small operations of repair and servicing.

In the body shops there are also in use simple power lifts which have a bearing plane with a mechanism involving pantograph trolleys which do not have almost totally the blocking devices for the vehicles because the stability of the vehicle is insured only for the operations in which substantial stresses or substantial drawing are not involved.

The problems described hereinabove are further aggravated in the case in which it is necessary to carry out repair operations or layout operations of the body shop or on the frame of heavy autovehicles. In fact, in order to work effectively and with safety on heavy autovehicles a particular stability of the structure of the power lift is required. However the known power lifts presently available for heavy materials require too much space and the operation of lifting the vehicle becomes difficult particularly in the first part of commencing the lifting operation.

In fact the known power lifts are provided with actuators which in the state in which it is necessary to form a pack act for lifting the vehicle in the first phases according to directions which are almost horizontal requiring therefore for lifting the vehicle very high pressures of the fluid and these pressures are incompatible with the common sources of pressure which are available to the body shops.

For the purpose of overcoming the problems related to the stresses and the first phases of lifting the vehicles various devices have been conceived which are constituted by stirrups capable of carrying out the initial push so as to improve the efficacy of the push of the actuators on the lifting levers.

Normally these devices used for improving the ratio between the lifting stroke and the pushing stroke are positioned corresponding to the articulation of the lifting levers but in the known configurations they have been shown to be effective only in the case of light vehicles because if they are used with heavy vehicles they are totally inadequate to limit the pressures necessary for the lifting of the vehicles at least in the initial phase.

SUMMARY OF THE INVENTION

The main object of the present invention is to provide a power lift which in the lowered condition occupies a minimum space and which allows to proceed easily in the operation of lifting the vehicle.

Related to the main object another important object of the present invention is to provide a power lift to be used in body shops for vehicles which has a structure of great stability so that it is possible to achieve the lifting of vehicles, even if they are heavy, by using limited pressures and which they are acceptable in the body shops with the lifting actuators.

Still another object of the present invention is to provide a power lift which is particularly safe for the operator and which can properly compete in production costs.

A still further object of the present invention is to achieve a power lift with a simple and a strong structure applicable in a multiplicity of situations and producible with known technology.

The main object and the other objects may be achieved with a power lift for body shops for vehicles of the type comprising a lower bearing plane provided with a lifting and a lowering group. This lifting group comprises corresponding to each of the longitudinal sides of the bearing plane a lifting and lowering mechanism in the arrangement of scissors constituted by two pairs of levers articulated between them in the middle section, one pair of parallel levers of this lifting group being provided with rollers which slide on the ground along a trajectory which is parallel to the longitudinal axis of the same plane, the other pair being hinged to the ground corresponding to the lower movable extremities. This mechanism is operated by at least one fluiddynamic actuator with one end being articulated to the lower arm of one of the two pairs of parallel levers and the other end being articulated by means of a corresponding stirrup with the upper arm of one of the other two levers.

The power lift is characterized by the fact that the stirrup is hinged to the related lever offering one free external extremity provided with a movable roller and in kinematic coupling in the very first lifting with a variable surface from a horizontal position to a position which is inclined with respect to the ground, the position being defined by a related shaped block.

Further characteristics and advantages of the present invention will be more clear from the following description of one embodiment by way of illustration but not limited by reference to the attached drawings of which:

Figure 1:
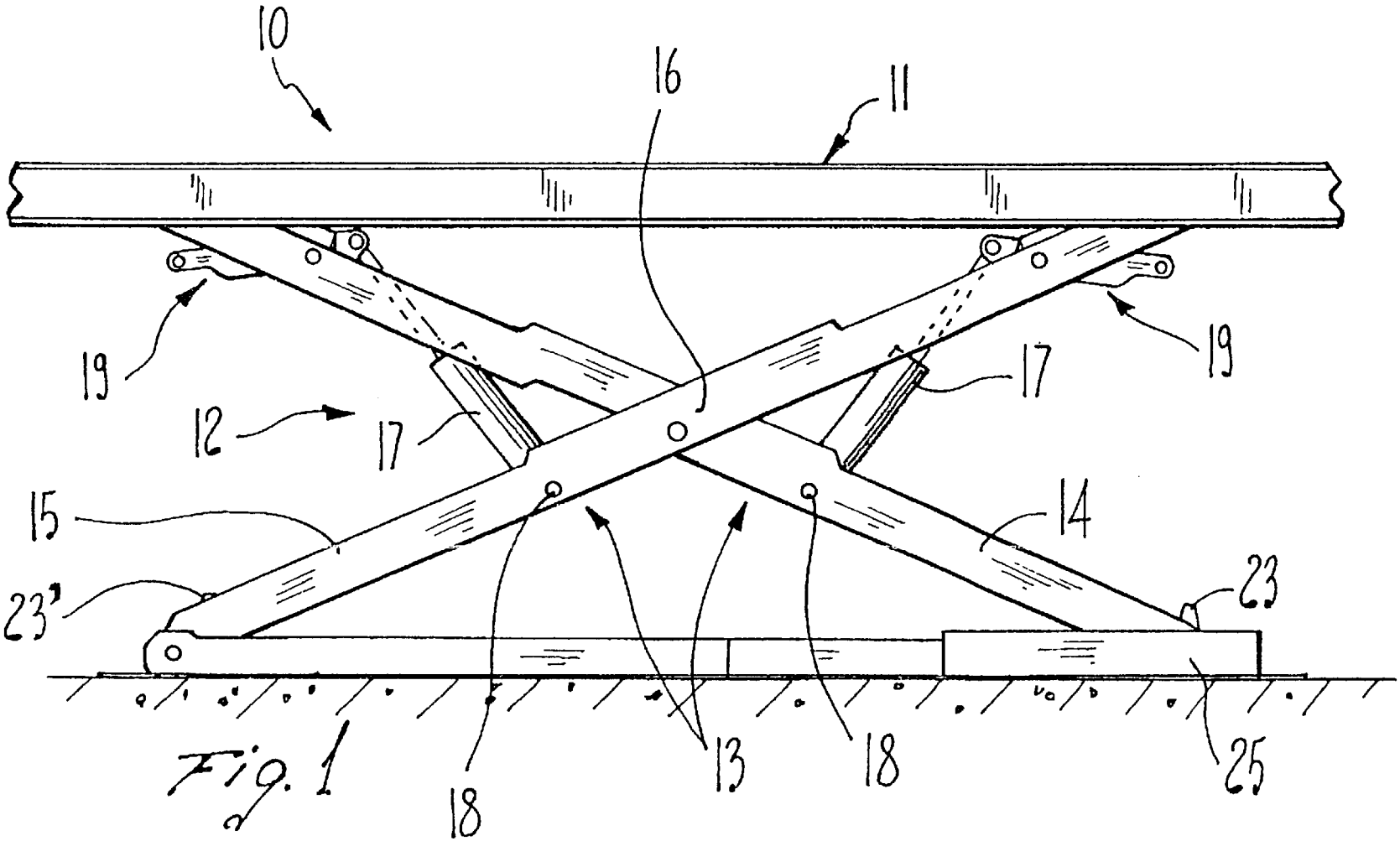
FIG. 1 illustrates in a orthogonal projection a power lift acccording to the present invention.

With particular reference to the figures the power lift for a body shop for vehicles according to the present invention is indicated by numeral 10. The power lift 10 comprises a bearing plane 11 of which the lower part is provided with a lifting and lowering group indicated altogether by the numeral 12. The group 12 comprises corresponding to each longitudinal size of plane 11 a related mechanism indicated with numeral 13. This mechanism of lifting and lowering has a scissors arrangement and is constituted by two pairs of levers respectively 14 and 15 articulated between themselves and a center section 16. The two pairs of levers are placed in motion by two fluiddynamic actuators 17. More precisely, group 12 in this case requires two internal levers 14 and two external levers 15.

In particular each one of the fluiddynamic actuators 17 of the power lift 10 has one end 18 which is articulated to the lower arms of the two pairs of levers 14 or 15 while the other end is articulated by means of a corresponding stirrup 19 to the upper arms to the other pair of levers 15 or 14.

Each one of the stirrups 19 is constituted by two first plates 19*a* having longitudinal development and fixed parallel between themselves by means of beams and is hinged to the related pair of levers 14 or 15 in an area close to the fulcrum of plane 11 at least outside of the center line between the fulcrum of the scissors and the free end of plane 11 corresponding to the upper quarter of the lever. The stirrup 19 has a free end 20 provided with roller 21 in related motion and in kinematic coupling in the first part of the lifting phase with an inclined surface 22 which in this case is linear with respect to the ground defined by a related shaped block 23.

Figure 2:
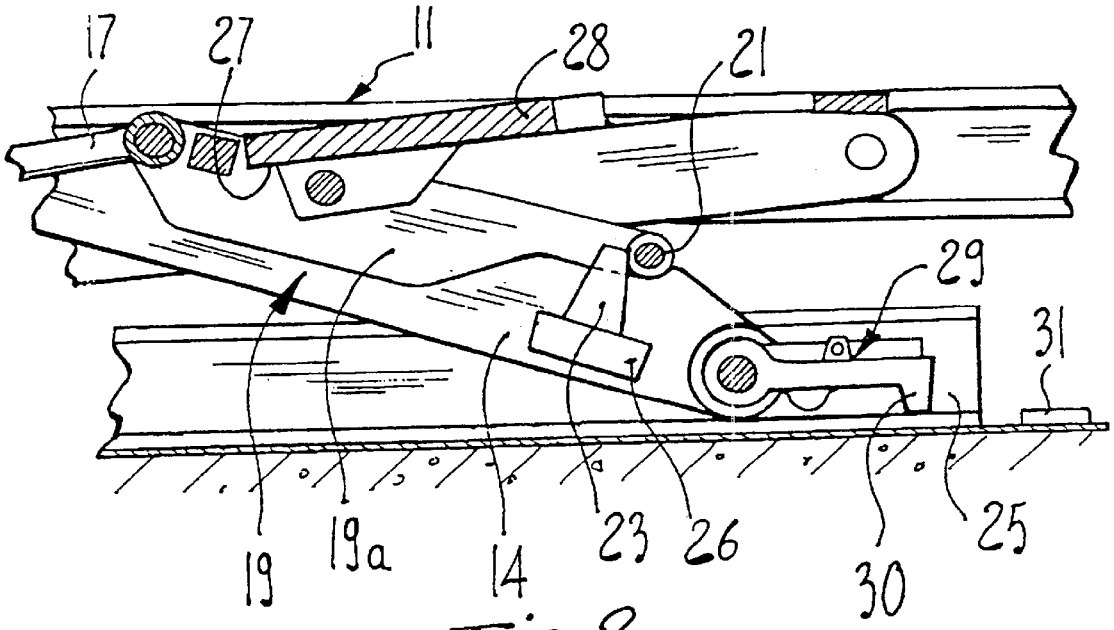
FIGS. 2, 3 and 4 illustrate in a orthogonal projection in cross section the same part of the power lift of FIG. 1 in three different operating phases.
Figure 3:
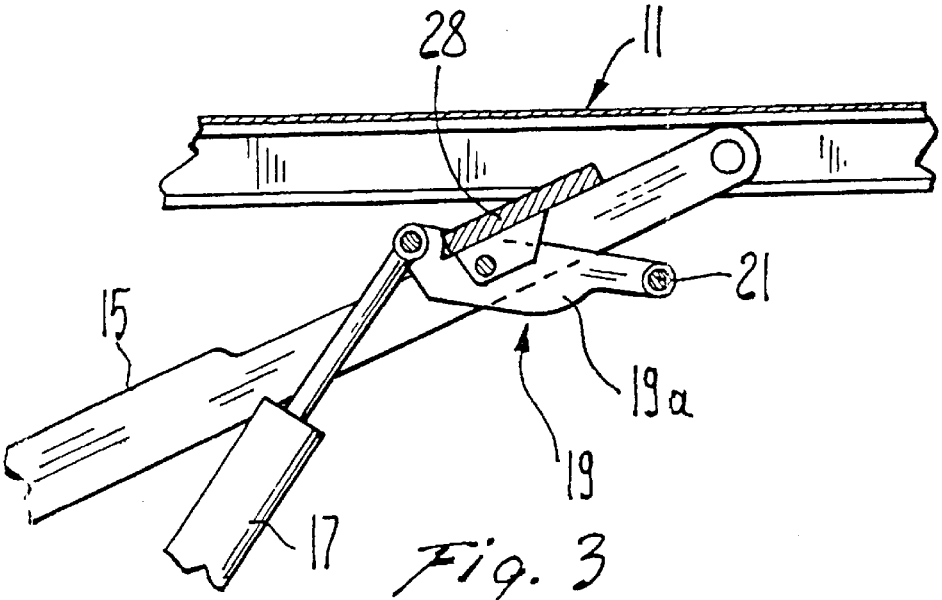
Figure 4:
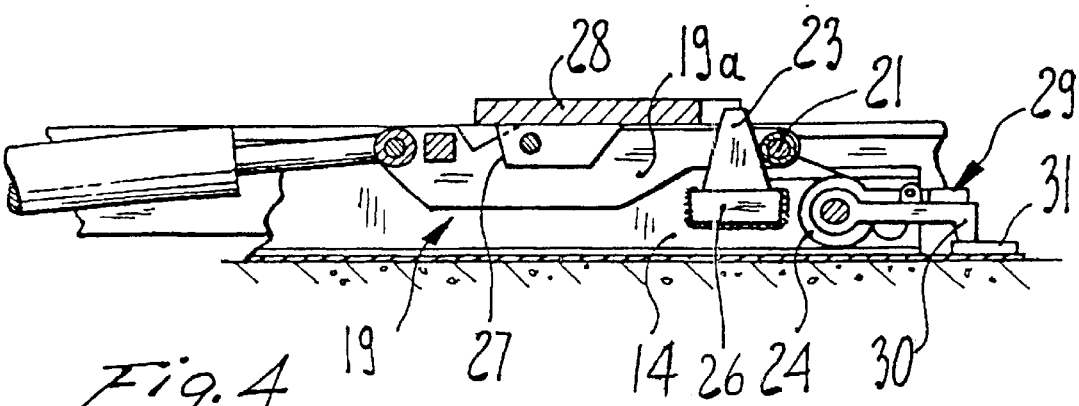
Figure 5:
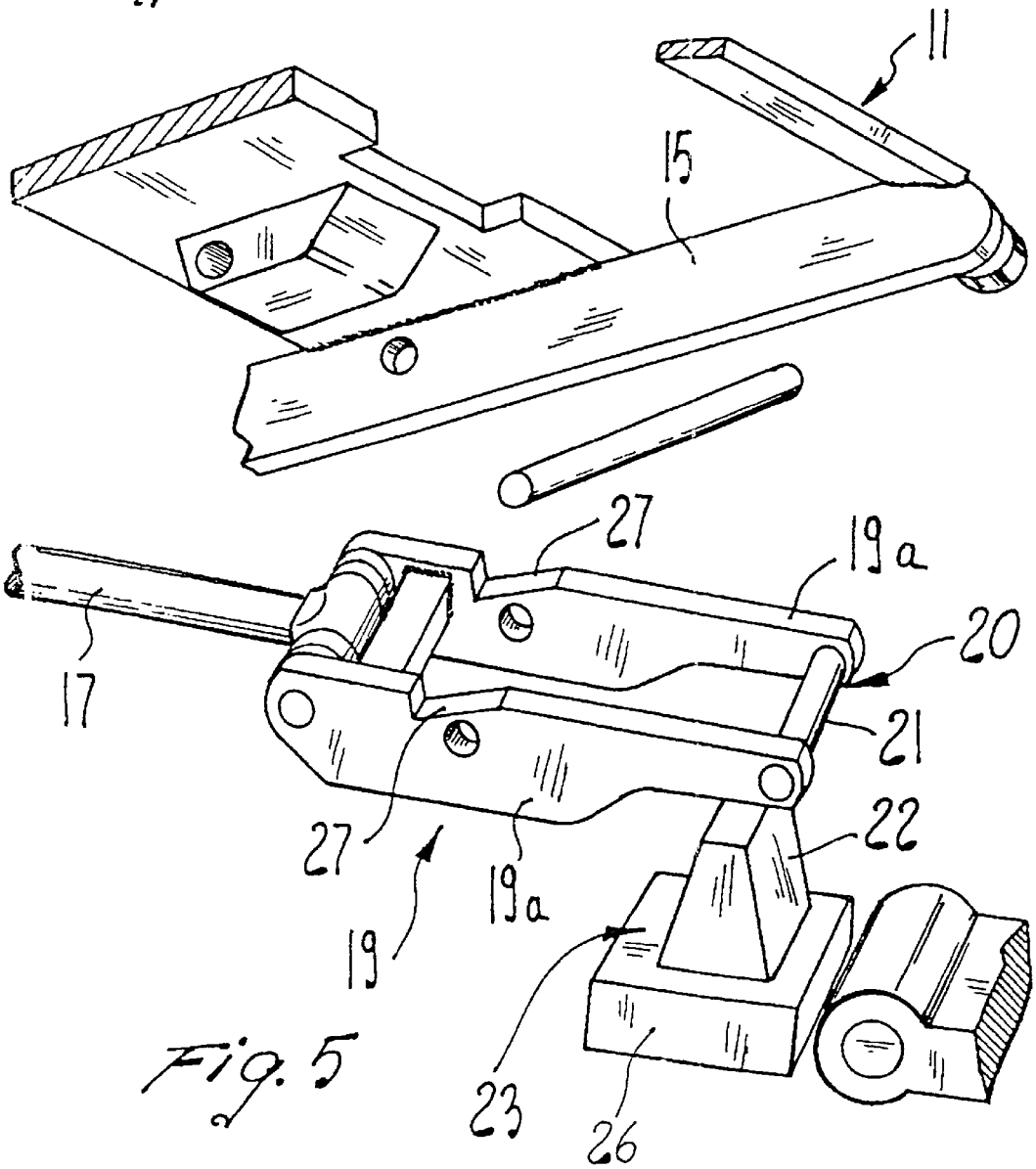
FIG. 5 is an exploded view of the same device of FIG. 2.

With respect to each of the mechanisms 13, the corresponding lever 14 has the lower end provided with roller 24 sliding on the ground in this case by interposition of longitudinal member 25 having a "C" cross section with a guiding concavity towards the interior while the levers 15 are hinged to the same longitudinal members 25. In this embodiment one of the two blocks 23 is fixed to a plate 26, the latter being welded to the lower ends of lever 14 as shown in FIG. 2, while the other block 23' partially visible in FIG. 1 is fixed to the ground, welded on the base between the lower hinged non-sliding ends and the corresponding levers 15.

According to another embodiment of the invention the use of a single block 23 fixed to the plate base 26 is provided, the latter being welded to the lower ends of levers 14.

Still according to another embodiment of the invention the use of a single block 23' fixed to the ground is provided, this block being fixed to a plate base welded to the lower ends of levers 15.

Still according to another embodiment of the invention the use of the two blocks 23 and 23' is provided, the two blocks being located one to the right and the other to the left of the center section 16, the two blocks being directly fixed to the ground or to the fixed base of the power lift instead of being anchored to the corresponding pairs of levers 14 and 15.

According to still another embodiment the use of only one of the two blocks 23 and 23' is provided, the block being fixed directly to the ground or to the fixed base of the power lift, precisely to the right or to the left of the middle portion 16.

Still according to another embodiment, two blocks are used, one block being fixed to a plate base welded to the sliding lower ends of the related levers, while the other block is welded to the hinged non-sliding lower ends of the related levers.

Each one of the stirrups 19 has corresponding to the upper border of each of its plates 19*a* a shaped recess section 27 capable of coupling to fix and favor the lifting push to the corner of a second plate 28 which is fixed to the upper part of a corresponding pair of levers 14 or 15.

In the case described hereinabove the surface of the block 23 as already stated hereinabove, is linear, but in other cases it is possible to provide surfaces of different shape, which may vary from a horizontal position to a position inclined with respect to the ground and formed according to suitable profiles capable of favoring the push action of the actuators 17 so that there is lowering of the pressure which must be produced in them. In particular each one of the fluiddynamicc actuators 17 has the lilower end associated to the corresponding pair of lever 14 or 15 positioned adjacently compatibly with kinematic requirements of the articulation of the corresponding levers 14 and 15 so as to achieve a high ratio between the lifting stroke and the push stroke. In addtion the upper parts of levers 15 and 14 of the related mechanism 13 result to be longer of the lower parts of the same in order to favor the formation of a pack.

The power lift 10 is also provided with a safety device of a type with a hook which is shown by the number 29. In particular the device 29 comprises a hook 30 which is hinged to the lower end of levers 14 and which in a case in which the fluid plant does not properly function, makes contact thereby preventing the closure of the mechanism in the form of scissors against a block 31 which is fixed to the ground.

In actual practice it has been noted that the present invention has provided the solution to the main object and also all the other objects defined hereinabove. In fact, it has been noted that the kinematic assembly constituted by the stirrup, actuator and the shaped block allows an increase in effectiveness due to the use of the pin of the actuator, thus reducing the pressures which are necessary to produce in the actuator in a case in which the vehicles being placed on the power lift are heavy. In addition it has been noted that the results have been obtained by means of a structure which is relatively easy and therefore producible at a cost which is competitive with respect to equivalent devices and further that the structure may be used by itself or together with analogous structures.

It has also been noted that the power lift according to the present invention is extremely functionable and may be easily placed in the form of a pack while taking reduced space.

Finally it has been noted that the power lift according to the invention allows to achieve a high ratio between the weight of the vehicle being lifted and the weight of the structure of the power lift.

Finally it should also be noted that the power lift according to the present invention allows to operate very easily and that the cost of purchasing the equipment and the servicing are reduced.

The present invention is susceptible to several modifications and variations which all fall within the scope of the concept. The details may be substituted with other technological equivalent structures. The material and inventions may be varied according to requirement in each case.

What is claimed is:

1. A power lift for body shops for vehicles of the type which comprises a bearing plane provided in the lower part thereof with a lifting and lowering group, the lifting group comprising corresponding to each of the longitudinal sides of said bearing plane a related lifting/lowering mechanism having a scissors arrangement, constituted by two pairs of levers articulated between themselvers in the middle section; one pair of said levers being parallel to said lifting group and being provided with rollers slidable on the ground along a trajectory parallel to the longitudinal axis of said plane; the other pair being hinged to the ground corresponding to the lower movable ends, said mechanism being operated by at least one fluiddynamic actuator; said actuator having an end articulated to the lower arm of one of the two pairs of parallel levers and the other end being articulated by means of a corresponding stirrup to the upper arm of one of the other two levers; said power lift being characterized by the fact that said stirrup is hinged to the corresponding lever one free external end of said stirrup being provided with a roller in motion and with a kinematic coupling with a surface which is variable from a horizontal position to an inclined position.

2. The power lift according to claim 1 characterized by the fact that said two pairs of levers articulated between themselves in a middle section are placed in motion by related fluiddynamic actuators, each one of said actuators has one end articulated to the lower arm of said two parallel levers and the other end is articulated to the upper arm of the other pair of levers by means of a corresponding stirrup, each one of said stirrups being hinged in a middle area to the related levers, offering the external free end provided with a related roller in motion and with kinematic coupling in the first part of the lifting phase with a surface which varies from a horizontal position to a position inclined with respect to the ground defined by a related shaped block.

3. The power lift according to claim 2 characterized by the fact that two blocks are provided,one of said blocks is fixed to a plate formed base welded to the slidable lower ends of the related levers while the other block is fixed to the ground welded on the base between said hinged non-slidable lower ends of the corresponding levers.

4. The power lift according to claim 2 characterized by the fact that each one of said stirrups is constituted by first plates having a longitudinal extension, said plates being fixed parallel between themselves by beams and is hinged to the related pair of levers.

5. The power lift according to claim 2 characterized by the fact that each one of said stirrups is hinged to the related pair of levers in an area to the outside of said middle area between the fulcrum of the scissors and the fulcrum of the upper plane specifically in the upper fourth part of the lever.

6. The power lift according to claim 2 characterized by the fact that each one of said stirrups has corresponding to the border of each of the related plates a corresponding shaped recess capable of coupling in order to favor and increase the lifting push to the corner of its second plate fixed to the upper part of a related lever.

7. The power lift according to claim 2 characterized by the fact that the surface in kinematic coupling with the roller of a related stirrup is linear.

8. The power lift according to claim 2 characterized by the fact that kinematic surface of coupling with a corresponding roller of a related stirrup is shaped according to a profile capable of optimizing the push of a corresponding actuator.

9. The power lift according to claim 2 characterized by the fact that a single block is used, said block being fixed to a plate base welded to the sliding lower ends of the related levers.

10. The power lift according to claim 2 characterized by the fact that a single block is provided, said block being fixed with relation to the ground and being fixed to a plate base welded to said hinged non-sliding lower ends of the corresponding levers.

11. The power lift according to claim 2 characterized by the fact that two blocks are used, provided, said blocks being located one to the right and the other to the left of the middle section resulting directly fixed to the ground and/or to the fixed base of said power lift.

12. The power lift according to claim 2 characterized by the fact that a single block is provided, located to the right or to the left of the middle section with the result that it is directly fixed to the ground and/or to the fixed base of the said power lift.

13. A power lift according to claim 2 characterized by the fact that two blocks are used, one of said blocks being fixed to a plate shaped base hinged to the sliding lower ends of the related levers and the other block is welded to the non-sliding hinged lower end of the corresponding levers.

14. A power lift according to claim 1 characterized by the fact that said actuators have the lower end opposite to the related stirrups hinged in proximity compatibly with kinematic requirements, to the central articulation of the levers to achieve a high ratio between the lifting stroke and the pushing stroke.

15. The power lift according to claim 1 characterized by the fact that the upper arms of said levers have a length greater with respect to the lower ends of said levers.

16. The power lift according to claim 2 characterized by the fact that each one of said mechanisms forms a complete pack with said levers one adjacent to the other.

17. The power lift according to claim 1 characterized by the fact that the rollers associated to the lower ends of the related levers slide in a guided manner along reflanged longitudinal members.

18. The power lift according to claim 1 characterized by the fact that it comprises at least a safety mechanism of the type including a hook associated to the lower ends of the movable levers and to a block fixed to the ground.

19. The power lift according to claim 1 characterized by the fact that one pair of parallel levers is internal and has a sliding lower end while the other pair is external and has non-sliding hinged lower ends.

* * * * *